US006498315B1

(12) United States Patent
Betz et al.

(10) Patent No.: US 6,498,315 B1
(45) Date of Patent: Dec. 24, 2002

(54) HIGH-VOLTAGE SWITCHING DEVICE HAVING AT LEAST TWO-SERIES-CONNECTED VACUUM INTERRUPTERS, AND A METHOD FOR OPERATION OF THE HIGH-VOLTAGE SWITCHING DEVICE

(75) Inventors: Thomas Betz, Langenselbold (DE); Ralf Heinemeyer, Ratigen (DE); Dieter König, Darmstadt (DE)

(73) Assignee: ABB Patent GmbH, Ladenburg (DE)

( * ) Notice: Subject to any disclaimer, the term of this patent is extended or adjusted under 35 U.S.C. 154(b) by 0 days.

(21) Appl. No.: 09/528,423

(22) Filed: Mar. 17, 2000

(30) Foreign Application Priority Data

Mar. 17, 1999 (DE) ..... 199 12 022

(51) Int. Cl.[7] ..... H01H 33/66; H01H 33/14

(52) U.S. Cl. ..... 218/120; 218/120; 218/154; 218/4

(58) Field of Search ..... 218/118, 120, 218/134–7, 155–6

(56) References Cited

U.S. PATENT DOCUMENTS

| | | | | |
|---|---|---|---|---|
| 3,708,638 A | * | 1/1973 | Mitchell | 218/118 |
| 3,814,882 A | * | 6/1974 | Harrold | 218/118 |
| 4,159,498 A | * | 6/1979 | Noeske | 218/118 |
| 4,204,101 A | * | 5/1980 | Dethlefsen | 218/120 |
| 4,383,150 A | * | 5/1983 | Cromer et al. | 218/118 |

FOREIGN PATENT DOCUMENTS

| | | | |
|---|---|---|---|
| FR | 2 075 511 | | 10/1971 |
| JP | 3-25822 | * | 2/1991 |
| JP | 4-179016 | * | 6/1992 |
| JP | 5-67414 | * | 3/1993 |

OTHER PUBLICATIONS

Paul G. Slade: "Electrical Contacts", Marcel Dekker, Inc. New York, Basel, 1999, Electrical engineering and electronics; 105, ISBN 0–8247–1934–4, p. 668 (No month).

* cited by examiner

*Primary Examiner*—Lincoln Donovan
(74) *Attorney, Agent, or Firm*—Laurence A. Greenberg; Werner H. Stemer; Gregory L. Mayback

(57) ABSTRACT

A high-voltage switching device is described having at least two series-connected vacuum switching chambers. The vacuum switching chambers, which are disposed in series, are configured differently with regard to their physical size and/or contact configuration, such as the contact diameters, a separation between the contacts, and contact types. At least one vacuum switching chamber of a first type is provided, and at least one vacuum switching chamber of a second type is provided. The vacuum switching chambers are selected in such a manner that re-ignitions and restrikes of a vacuum switching chamber of the first type are coped with by at least one other vacuum switching chamber of the second type. The opening of the contacts of the two vacuum switching chambers at different times is used as an additional method for operation of the high-voltage switching device.

8 Claims, 4 Drawing Sheets

HIGH-VOLTAGE SWITCHING DEVICE HAVING AT LEAST TWO-SERIES-CONNECTED VACUUM INTERRUPTERS, AND A METHOD FOR OPERATION OF THE HIGH-VOLTAGE SWITCHING DEVICE

BACKGROUND OF THE INVENTION

FIELD OF THE INVENTION

The invention relates to a high-voltage switching device having at least two series-connected vacuum interrupters and to a method for operating the high-voltage circuit breaker. The invention may be used, for example, in gas-insulating switching assemblies. In this context, the term "high voltage" is defined as a voltage range above 1000 V.

In high-voltage switchgear, vacuum interrupters are disposed in series in specific cases on the basis of two fundamental principles, to be precise in an uncontrolled configuration according to the reference by H. Fink, and E. Sonnenschein, titled "SF6-isolierte 52-kV-Mittelspannungs-Schaltanlage mit Vakuumschalter" [SF6-Insulated 52-kV Medium-Voltage Switchgear Assembly Having A Vacuum Switch], etz, Vol. 115 (1994), Issue 11, pages 622–626, using control capacitors. In the uncontrolled configuration, the primary factor is the use of the vacuum switching principle at voltage levels above 36 kV, provided by disposing two vacuum switching chambers (standard chambers), which are limited to the rated voltage of 36 kV, in series. In this case, an unavoidable scatter resulting from stray capacitances in terms of the potential splitting is accepted, for financial reasons. The series configuration must therefore be configured on the basis of the vacuum switching chamber which is most severely stressed due to the inhomogeneous voltage distribution, while the other vacuum switching chamber is subjected to less voltage stress, and is thus not optimally utilized.

One example of a series configuration of two vacuum switching chambers configured with control capacitors is provided for use for railway power supplies, at a frequency of 16 2/3 Hz. In comparison with the arcing times of 10 ms/8.3 ms that occur with 50 Hz/60 Hz, the contact gaps at 16 2/3 Hz are subject to arcing times of 30 ms. The associated comparatively severe thermal stress, and the resultant severely increased erosion (burn-off) lead to a major reduction in the withstand voltage during disconnection. This effect is counteracted by connecting two vacuum switching chambers in series, and additionally controlling them capacitively, for rated voltages of, for example, 17.5 kV.

The previous configuration of series arrangements of two or more vacuum switching chambers is in principle predicated on the use of identical switching chambers, which are each switched on and off simultaneously.

The integration of the series configuration of two vacuum switching chambers as the core of a high-voltage switching device requires capacitive control, especially for use within a gas-insulated switchgear assembly. The background to this measure is linearization of the voltage distribution across the two vacuum switching chambers, although the control capacitances must not be able to have a disadvantageous influence on the extinguishing capacity, as is dealt with in the reference by T. Betz. D. Koenig, titled "Influence Of Grading Capacitors On The Breaking Capability Of Two Vacuum Circuit-Breakers In Series", IEEE 18th Int. Symp. on Discharges and Electrical Insulation in Vacuum, pp. 679–683, Eindhoven, The Netherlands, Aug. 17–21, 1998.

SUMMARY OF THE INVENTION

It is accordingly an object of the invention to provide a high-voltage switching device having at least two series-connected vacuum interrupters, and a method for operation of the high-voltage switching device which overcome the above-mentioned disadvantages of the prior art devices and methods of this general type, which can be optimally utilized with regard to voltage loading. In this case, the described measures are intended to ensure that the series configuration can compensate for the influences on the disconnection capability (which differ depending on the geometry, operational conditions and environmental conditions) without having to use rigid control from the outside with the aid of control capacitors.

With the foregoing and other objects in view there is provided, in accordance with the invention, a high-voltage switching device, containing at least two series-connected vacuum switching chambers, including at least one first-type vacuum switching chamber and at least one second-type vacuum switching chamber, the first-type vacuum switching chamber and the second-type vacuum switching chamber each having a physical size and a contact configuration containing contacts with contact diameters, a separation between the contacts, and contact types, in which at least one of the physical size and the contact configuration of the first-type vacuum switching chamber being differently configured than that of the second-type of vacuum switching chamber, and the vacuum switching chambers selected such that re-ignitions and restrikes of the first-type vacuum switching chamber being coped with by the second-type vacuum switching chamber.

The advantages that can be achieved by the invention are, in particular, that the voltage distribution is achieved on the basis of a natural voltage distribution, influenced exclusively by the intrinsic and stray capacitances, and without any additional control capacitances. This avoids the compensation currents which are produced on re-ignition or restriking of a vacuum switching chamber and flow via the control capacitances, whose amplitudes rise as the control capacitance becomes larger, thus leading to heating of the contacts of the vacuum switching chambers and, in the end, reducing the disconnection capacity.

As a particular advantage, it is possible to achieve the object of coping with switching situations (short-circuit disconnection capacity, connection capacity) independently of the object of coping with the dielectric requirements, by suitable selection of the vacuum switching chambers.

The arcing behavior can be influenced directly by additional measures on the drive unit, thus allowing the introduction of a separate degree of freedom for the configuration of both the dielectric behavior and the disconnection behavior when subject to arcing influences.

The proposed measures lead to a different arcing behavior due to the combination of different vacuum switching chambers with a different physical size (different rated voltage, different disconnection current) and/or different contact configuration (different contact diameters, different separation between the contacts, different contact types), and generally different intrinsic capacitances. By deliberate use of this effect, the configuration versatility to cope with individual switching situations can be considerably increased in comparison with known configurations. If, for example, two suitable different vacuum switching chambers with different contact diameters are used in series, then the different intrinsic capacitances of the vacuum switching chambers and the different arcing behavior can advantageously be combined with the aim of increasing the switching capacity.

The background to the use of series connected vacuum switching chambers is the desire to exploit both the technical advantages of the vacuum circuit-breaker in the form of a high di/dt and du/dt disconnection capacity (di/dt=current grading, du/dt=voltage grading) and the economic advantages, such as freedom from maintenance, low drive energy and compact construction. These advantages are particularly pronounced in the case of vacuum switching chambers with short contact separations between the contacts and, by linking two or more vacuum switching chambers, and thus switching paths, in series, can be used to allow vacuum switching chambers to be operated even at higher rated voltages, beyond the 36 kV voltage range. This results in possible alternatives to sulfur hexafluoride ($SF_6$) which, until now, has been the dominant extinguishing medium in the voltage range above 36 kV, and these alternatives are also of interest in terms of environmental aspects.

The high-voltage switching device may also contain a housing; a series connection of at least two vacuum interrupters (i.e. quenching chamber or combination of quenching and switching chamber); disposed in the housing; and insulation disposed in the housing between the chambers and the housing, the insulation being selected from the group consisting of $SF_6$, $N_2$, air, gaseous dielectrics and liquid dielectrics.

Other features which are considered as characteristic for the invention are set forth in the appended claims.

Although the invention is illustrated and described herein as embodied in a high-voltage switching device having at least two series-connected vacuum interrupters, and a method for operation of the high-voltage switching device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
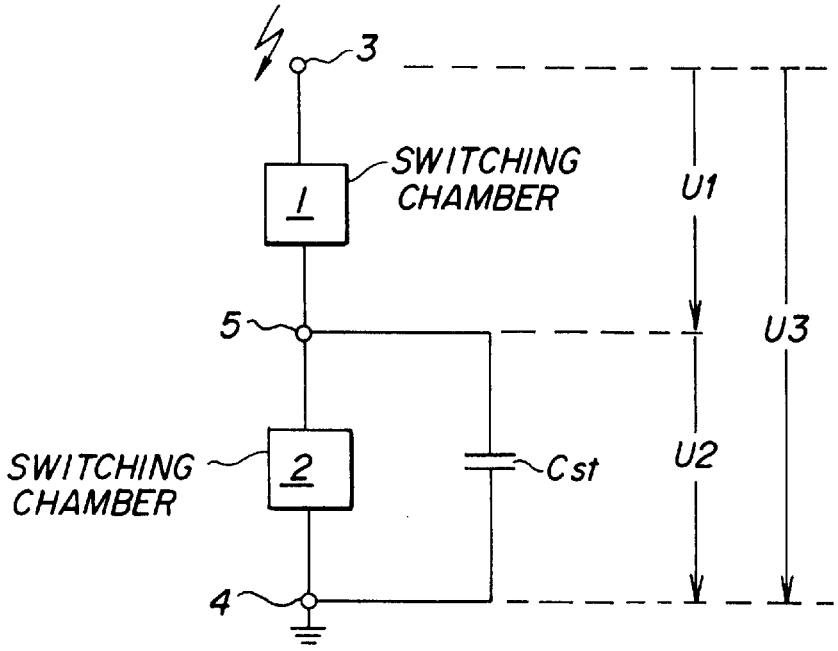
FIG. 1 is a block circuit diagram of series-connected vacuum switching chambers for high-voltage switchgear according to the invention.

A high-voltage switching device has to carry out two main tasks. First, it has to withstand dielectric stresses when the contacts are open, and second, it has to cope with thermal and mechanical effects during a disconnection of a short-circuit arc. After successfully quenching the short-circuit current, it has to withstand a returning voltage in the form of a transient decaying-oscillation process. The associated time period lasts for more than several hundred microseconds and, in the case of the series configuration, is evidently dominated by the choice of the capacitive circuitry and the plasma processes in the interior of an interrupter in the form of a switching chamber. A deliberate influence on the transient processes which follow the end of the arcing time period is intended to be achieved by a different configuration of the vacuum switching chambers and of the contacts, by measures relating to the drive, and by the use of different arcing characteristics. In this case, the capability for series connection is intended to be used such that, in the event of restriking in a switching chamber, the switching chamber that is not affected can accept the entire voltage stress. In the following text, this is referred to as the transfer process, and represents a particular advantage of capacitive switching to cope with restrikes.

In all the figures of the drawing, sub-features and integral parts that correspond to one another bear the same reference symbol in each case. Referring now to the figures of the drawings in detail and first, particularly, to FIG. 1 thereof, there is shown an outline circuit diagram of series-connected vacuum switching chambers for high-voltage switchgear, using the example of one switch pole. A first vacuum switching chamber 1 and a second vacuum switching chamber 2 are connected in series between a connection 3 on the high-voltage side, and a connection 4 on the earth side. A stray capacitance Cst, which needs to be taken into account, occurs between a common junction point 5 between the two vacuum switching chambers 1, 2 and the connection 4 on the earth side.

Figure 2:
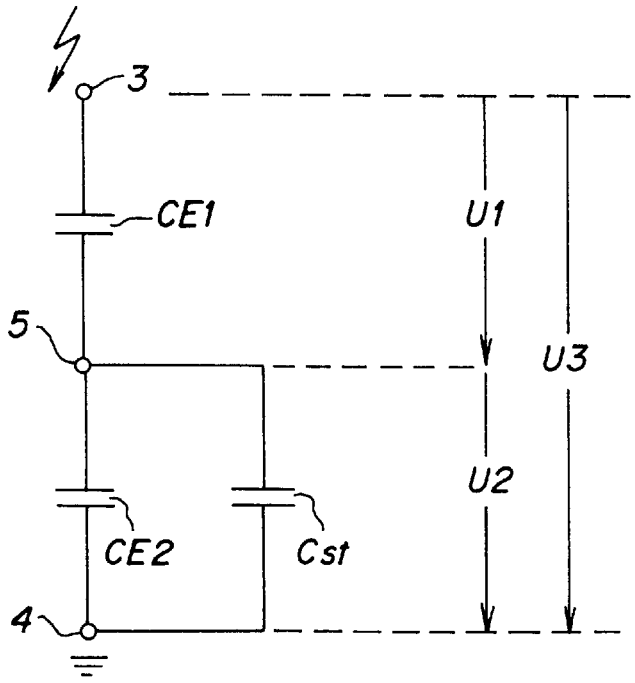
FIG. 2 is a circuit diagram of a simplified equivalent circuit relating to potential splitting.

FIG. 2 shows a simplified circuit diagram relating to potential partitioning. As can be seen, the intrinsic capacitance CE1 of the first vacuum switching chamber 1 is connected in series with a parallel circuit formed by an intrinsic capacitance CE2 of the second vacuum switching chamber 2 and the stray capacitance Cst. Both FIG. 1 and FIG. 2 show the partial decaying-oscillation voltage Ul across the first vacuum switching chamber 1, the partial decaying-oscillation voltage U2 across the second vacuum switching chamber 2, and the total decaying-oscillation voltage U3=U1+U2.

The invention is based on the principle of two or more different vacuum switching chambers 1, 2 being disposed in series as the core of a high-voltage switching device. The use of different vacuum switching chamber types within one switch pole allows both the intrinsic capacitances and the arcing behaviour of the two different vacuum switching chambers to be combined with regard to the voltage stress and the quenching capacity of the series configuration, in an advantageous manner.

One specific feature of the invention is the configuration of the first vacuum switching chamber 1, which is connected to the connection 3 on the high-voltage side, with a contact 11 having a larger contact diameter 011, and thus an increased intrinsic capacitance CE1. The second vacuum switching chamber 2, which is connected to the connection 4 on the earth side, in contrast has a contact 12 with a small contact diameter 012, with a correspondingly comparatively lower intrinsic capacitance CE2, but, when installed, is supplemented by the stray capacitance Cst that acts to earth potential (see FIGS. 4 and 5). If the vacuum switching chamber types are chosen suitably, the influence of the stray capacitances can thus be minimized or completely eliminated. The condition relating to this is:

$$CE1 = CE2 + Cst.$$

Suitable selection of the intrinsic capacitances of the vacuum switching chambers 1, 2 to compensate for the stray capacitances that act results in the potential partitioning of an uncontrolled switch pole being linearized, which is a major advantage particularly when the high-voltage switching device is used in a gas-insulated switchgear assembly since, in this application, the stray capacitances that act are higher.

A further advantage of the series configuration of at least two vacuum switching chambers 1, 2 is that restriking of one vacuum switching chamber does not necessarily lead to restriking of the entire switch pole. This is due to the fact that the withstand voltage of the unrelated switching chamber has progressed considerably at the restriking time. Especially in the case of capacitive switching, this results in the optimized voltage transfer capability, owing to suitable selection of the series-connected, different vacuum switching chambers.

A different arcing behaviour can be obtained by opening the contacts of the at least two vacuum switching chambers 1, 2 at different times. When the two vacuum switching chambers 1, 2 are connected in series, both the contacts 11, 12 of the upper vacuum switching chamber 1 and those of the lower vacuum switching chamber 2 can be opened with a time delay. If the vacuum switching chambers 1, 2 are switched on and off at different times, this results in a desirable manner in deliberate distribution of the switching stresses between the two vacuum switching chambers, expressed by the proportion of the voltage that recurs after a switching operation, as a result of this measure on the respective vacuum switching chamber. Furthermore, if the vacuum switching chambers 1, 2 are switched on and off at different times, the voltage distribution can be influenced in a desirable, advantageous manner, with pure, dielectric voltage stresses.

Multiple restrikes, which occur predominantly with short contact separations in the upper vacuum switching chamber 1, have a conditioning effect on the quenching behaviour of the lower vacuum switching chamber 2, and lead to an increase in the withstand voltage in comparison to a configuration with only one vacuum switching chamber.

A particular characteristic of a series configuration containing at least two vacuum switching chambers, especially for capacitive switching, is the advantage that re-ignition and restrikes of one vacuum switching chamber from the other vacuum switching chamber (or a plurality of other vacuum switching chambers) are coped with. In this case, the primary factor is not so much the suitability of the vacuum switching principle to achieve higher rated voltages, but the exploitation of the technical advantages of a series configuration of at least two vacuum switching chambers for a specific switching situation which, related to the rated voltage normally required in the 36 kV voltage range, could be coped with by just a single vacuum switching chamber.

Figure 3:
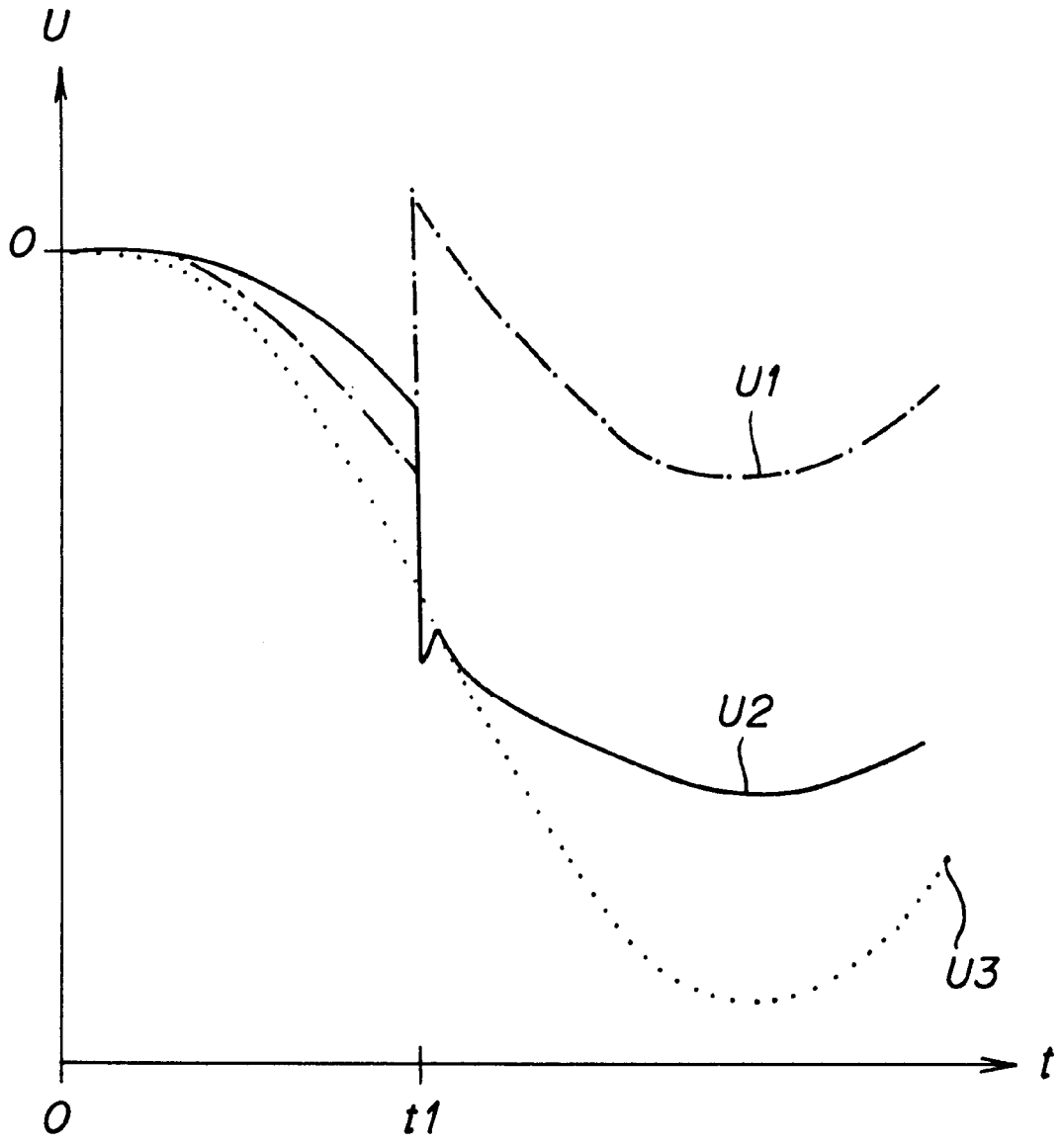
FIG. 3 is a voltage/time graph for explaining the phenomenon of voltage transfer by a vacuum switching chamber on re-ignition of a further vacuum switching chamber.

In this context, FIG. 3 shows a voltage/time diagram to explain the phenomenon of voltage transfer by a voltage switching chamber when restriking occurs in the further vacuum switching chamber. The graph in FIG. 3 shows the profile of the transient recovery voltages U as a function of time t.

At time 0, the main voltage, which returns once the arc has been successfully quenched, starts in a form of a transient decaying-oscillation voltage U3. The total decaying-oscillation voltage U3 illustrated by dotted lines is split across the series configuration so as to produce a partial decaying-oscillation voltage Ul (shown by dashed-dotted lines) and a partial decaying-oscillation voltage U2 (solid line). The first (upper) vacuum switching chamber 1 restrikes at the time t1. The second (lower) vacuum switching chamber 2 takes over the entire voltage stress at this time t1, that is to say the total decaying-oscillation voltage U3 acting at this time. The upper vacuum switching chamber 1 then recovers, and can once again accept a small proportion of the total voltage U3.

The disconnection behaviour of the series circuit can be traced back, taking account of the potential partitioning, to the singular behaviour of the individual vacuum switching chambers. In the first microseconds of the decaying-oscillation voltage, the potential split is governed by non-reactive (plasma) resistances due to the post-arc current, and these describe the recovery process within the switching path. Even after a few microseconds, the plasma resistance has already grown sufficiently strongly for the intrinsic and stray capacitances to govern the voltage split across the two switching paths. The voltage split is primarily influenced by the stray capacitance Cst of the (lower) vacuum switching chamber 2 to earth, that is to say the stray capacitance Cst acts in the sense of advance control (but without the disadvantages as explained above).

Figure 4:
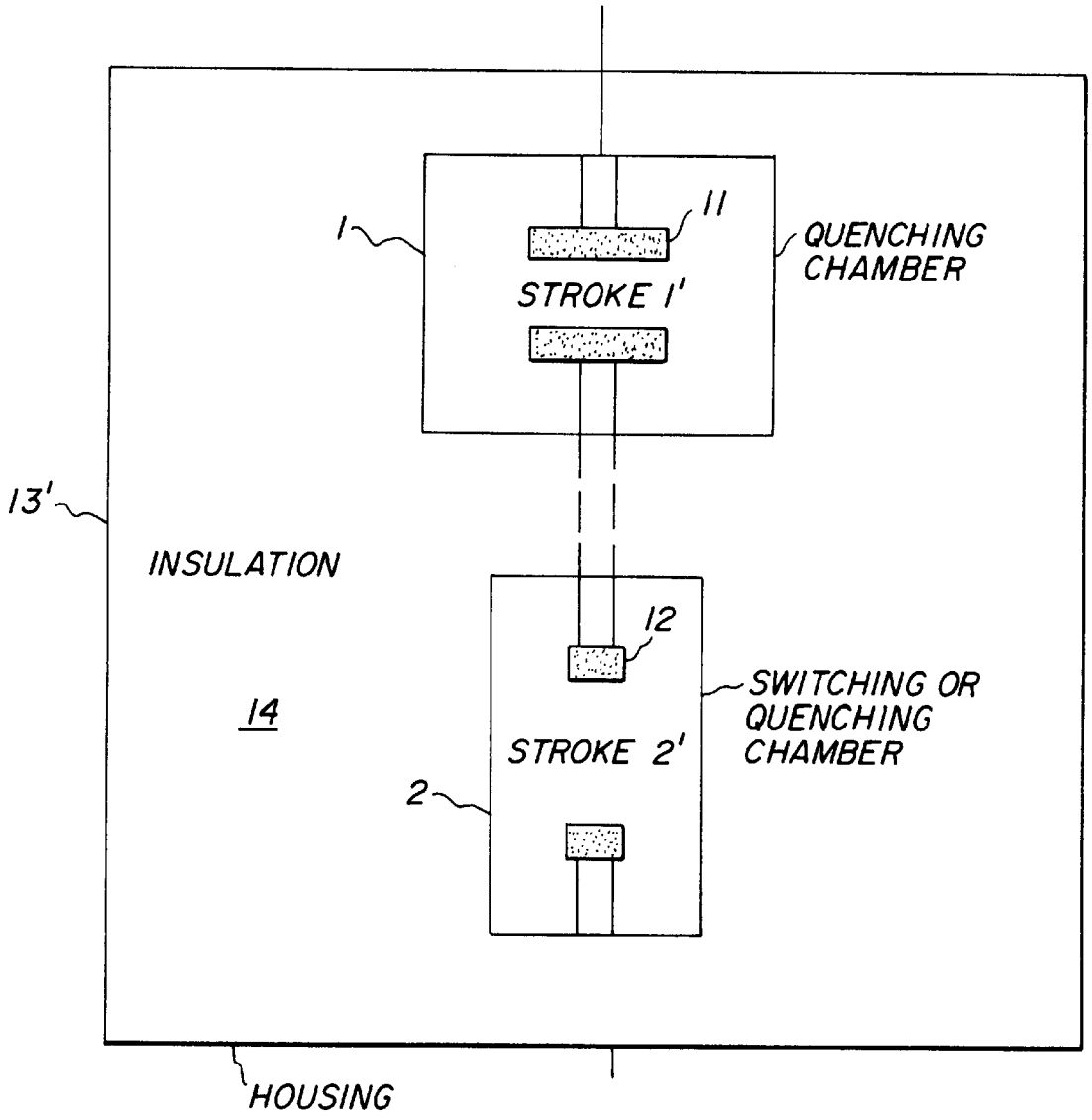
FIG. 4 is a block diagram of a housing containing the switching chambers.
Figure 5:
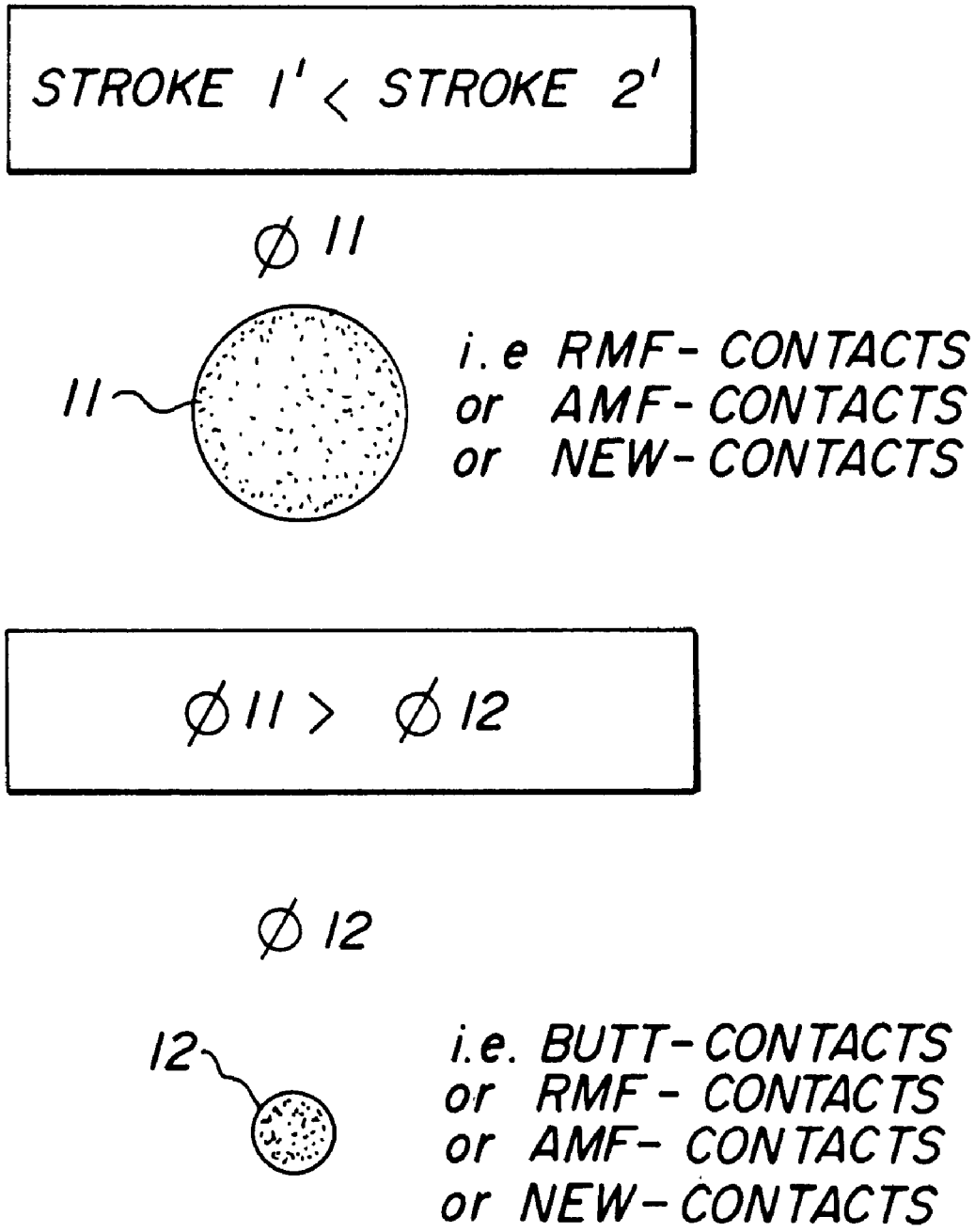
FIG. 5 is a plan view of contacts.

FIG. 4 shows a housing 13 in which the first vacuum switching chamber 1 functions as a quenching chamber and the second vacuum switching chamber 2 functions as either a quenching chamber or a switching chamber. It is noted that a stroke 1' of the first vacuum switching chamber 1 is less than a stroke 2' of the second vacuum switching chamber 2. An insulation 14 is disposed in the housing 13 and can be $SF_6$, $N_2$, air, a gaseous dielectric or a liquid dielectric.

We claim:

1. A high-voltage switching device, comprising:

at least two series-connected vacuum switching chambers, including at least one first-type vacuum switching chamber and at least one second-type vacuum switching chamber, said first-type vacuum switching chamber and said second-type vacuum switching chamber each having a physical size and a contact configuration containing contacts with contact diameters, a separation between said contacts, and contact types, in which at least one of said physical size and said contact configuration of said first-type vacuum switching chamber being differently configured than that of said second-type of vacuum switching chamber, and said vacuum switching chambers selected such that re-ignitions and restrikes of said first-type vacuum switching chamber are controlled by said at least one said second-type vacuum switching chamber;

said contacts of said second vacuum switching chamber opening after said contacts of said second vacuum switching chamber have been opened;

said contacts of said second vacuum switching chamber closing before said contacts of said first vacuum switching chamber;

said first-type vacuum switching chamber being for connecting to a connection on a high-voltage side and having a first intrinsic capacitance, said second-type vacuum switching chamber being for connecting to a ground and having a second intrinsic capacitance smaller than said first intrinsic capacitance; and a stray capacitance connected in parallel to said second-type vacuum switching chamber, a sum of said second intrinsic capacitance and said stray capacitance being approximately equal to said first intrinsic capacitance.

2. The high-voltage switching device according to claim 1, including:

a housing containing said vacuum chambers, said first-type vacuum switching chamber functioning as a quenching chamber; and insulation disposed in said housing between said quenching chamber and said housing, said insulation selected from the group consisting of $SF_6$, $N_2$, air, gaseous dielectrics and liquid dielectrics.

3. A method for operation of the high-voltage switching device, which comprises:

providing a high-voltage switching device having at least two series-connected vacuum switching chambers, including at least one first-type vacuum switching chamber and at least one second-type vacuum switching chamber, the first-type vacuum switching chamber and the second-type vacuum switching chamber each having a physical size and a contact configuration containing contacts with contact diameters, a separation between the contacts, and contact types, in which at least one of the physical size and the contact configuration of the first-type vacuum switching chamber being differently configured than that of the second-type of vacuum switching chamber, and the vacuum switching chambers selected such that re-ignitions and restrikes of the first-type vacuum switching chamber are controlled by the at least one second-type vacuum switching chamber; said first-type vacuum switching chamber being for connecting to a connection on a high-voltage side and having a first intrinsic capacitance, said second-type vacuum switching chamber being for connecting to a ground and having a second intrinsic capacitance smaller than said first intrinsic capacitance; and a stray capacitance connected in parallel to said second-type vacuum switching chamber, a sum of said second intrinsic capacitance and said stray capacitance being approximately equal to said first intrinsic capacitance;

opening the contacts of the second vacuum switching chamber after opening the contacts of the first vacuum switching chamber; and closing the contacts of the second vacuum switching chamber before closing the contacts of the first vacuum switching chamber.

4. A gas-insulated switchgear assembly, comprising:

a high-voltage switching device, including:

at least two series-connected vacuum switching chambers, having at least one first-type vacuum switching chamber and at least one second-type vacuum switching chamber, said first-type vacuum switching chamber and said second-type vacuum switching chamber each having a physical size and a contact configuration containing contacts with contact diameters, a separation between said contacts, and contact types, in which at least one of said physical size and said contact configuration of said first-type vacuum switching chamber being differently configured than that of said second-type of vacuum switching chamber, and said vacuum switching chambers selected such that re-ignitions and restrikes of said first-type vacuum switching chamber being coped with by said at least one said second-type vacuum switching chamber;

said contacts of said second vacuum switching chamber opening after said contacts of said second vacuum switching chamber have been opened; and said contacts of said second vacuum switching chamber closing before said contacts of said first vacuum switching chamber;

said first-type vacuum switching chamber being for connecting to a connection on a high-voltage side and having a first intrinsic capacitance, said second-type vacuum switching chamber being for connecting to a ground and having a second intrinsic capacitance smaller than said first intrinsic capacitance; and a stray capacitance connected in parallel to said second-type vacuum switching chamber, a sum of said second intrinsic capacitance and said stray capacitance being approximately equal to said first intrinsic capacitance.

5. The high voltage switching device according to claim 2, wherein said second-type vacuum switching chamber functions as a quenching chamber.

6. The high-voltage switching device according to claim 1, including a common drive operating said first-type vacuum interrupter and said second-type vacuum interrupter.

7. The method according to claim 3, which further comprises operating the first-type vacuum interrupters and the second-type vacuum interrupters with a common drive.

8. The gas-insulated switchgear assembly according to claim 4, including a common drive operating said first-type vacuum interrupter and said second-type vacuum interrupter.

* * * * *